US012104515B2

(12) United States Patent
Zhang et al.

(10) Patent No.: US 12,104,515 B2
(45) Date of Patent: Oct. 1, 2024

(54) METHOD, COMPUTING UNIT, AND COMPUTER PROGRAM FOR OPERATING A BURNER

(71) Applicant: Robert Bosch GmbH, Stuttgart (DE)

(72) Inventors: Chao Zhang, Beilstein (DE); Christian Disch, Wimsheim (DE); Erwin Schiele, Flein (DE); Markus Deissler, Heilbronn (DE); Winfried Langer, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/489,715

(22) Filed: Oct. 18, 2023

(65) Prior Publication Data

US 2024/0133328 A1 Apr. 25, 2024
US 2024/0229696 A9 Jul. 11, 2024

(30) Foreign Application Priority Data

Oct. 20, 2022 (DE) ..... 10 2022 211 127.3

(51) Int. Cl.
*F01N 3/00* (2006.01)
*F01N 3/20* (2006.01)

(52) U.S. Cl.
CPC ..... *F01N 3/2033* (2013.01); *F01N 2240/14* (2013.01); *F01N 2900/04* (2013.01)

(58) Field of Classification Search
CPC . F01N 3/2033; F01N 2240/14; F01N 2900/04
See application file for complete search history.

(56) References Cited

U.S. PATENT DOCUMENTS 5,353,591 A * 10/1994 Kabasin ..... F23N 5/203 60/274
5,571,484 A * 11/1996 Pettit ..... F01N 3/2033 422/177
11,492,944 B2 * 11/2022 Hemminger ..... F01N 3/025
2003/0221425 A1 * 12/2003 Posselt ..... F01N 3/2033 60/303
2005/0153252 A1 * 7/2005 Crawley ..... F01N 13/009 431/5
2006/0046218 A1 * 3/2006 Joklik ..... F02D 41/1497 431/75

(Continued)

FOREIGN PATENT DOCUMENTS

DE 4132814 A1 4/1993
DE 19504208 A1 8/1995

(Continued)

*Primary Examiner* — Matthew T Largi
(74) *Attorney, Agent, or Firm* — Michael Best & Friedrich LLP

(57) ABSTRACT

A method for operating a burner, comprising supplying a controlled quantity of combustion air to the burner, supplying a controlled quantity of fuel to the burner, igniting the air-fuel mixture in the burner, determining a pressure pulsation value in the exhaust gas downstream of the burner and/or in an air path upstream of the burner, and adjusting the quantity of combustion air and/or the fuel depending on the pressure pulsation value. Further proposed are a computing unit and a computer program product for performing such a method.

8 Claims, 3 Drawing Sheets

(56) References Cited

U.S. PATENT DOCUMENTS

| | | | | |
|---|---|---|---|---|
| 2007/0157606 | A1* | 7/2007 | Schenck Zu Schweinsberg | F01N 3/36 60/303 |
| 2009/0229238 | A1 | 9/2009 | Zhang et al. | |
| 2010/0154745 | A1* | 6/2010 | Gaiser | F23N 1/022 431/89 |
| 2011/0203261 | A1* | 8/2011 | Kotrba | F01N 3/2066 60/299 |
| 2014/0080075 | A1* | 3/2014 | Young | F23N 1/022 431/18 |
| 2020/0224573 | A1* | 7/2020 | Williges | F01N 3/035 |
| 2020/0232364 | A1* | 7/2020 | Baron Von Ceumern-Lindenstjerna | F01N 9/00 |
| 2023/0049216 | A1* | 2/2023 | Garagnani | F01N 3/025 |

FOREIGN PATENT DOCUMENTS

| | | | |
|---|---|---|---|
| DE | 102010002586 | A1 | 9/2011 |
| DE | 102020202136 | A1 | 8/2021 |

* cited by examiner

METHOD, COMPUTING UNIT, AND COMPUTER PROGRAM FOR OPERATING A BURNER

BACKGROUND

The present invention relates to a method for operating a burner, in particular in an exhaust system of an internal combustion engine, as well as a computing unit and a computer program for performing said method.

Three-way catalysts (TWC) can be used to achieve legally prescribed emission limits by converting the relevant gaseous pollutants $NO_x$, HC, and CO into harmless products such as $N_2$, $H_2O$ and $CO_2$. In order for these catalytic reactions to proceed as intended, the temperatures in the catalyst generally must exceed what is referred to as the light-off temperature, which is typically 300-400° C. As soon as this temperature is reached or exceeded, the catalyst converts the relevant pollutants almost completely (referred to as a catalyst window).

In order to achieve this state as quickly as possible, what are referred to as internal motor catalytic converter heat uptakes can be applied. The efficiency of the gasoline engine is thereby deteriorated by late ignition angles, and the exhaust air temperature and enthalpy input into the catalyst is increased. Using adapted injection strategies (e.g., multiple injections), combustion stability can simultaneously be ensured.

In addition to these internal motor catalyst heating measures, external catalyst heating measures can also be used, e.g., by means of electrically heatable catalysts or exhaust gas burners. Such external heating measures are, e.g., described in DE 41 32 814 A1 and DE 195 04 208 A1.

In order to further reduce emissions in comparison to conventional operation with internal motor heating measures, in particular during cold departures, i.e., high loads on the combustion engine in the cold state without an idling phase, what are referred to as catalyst burners have proven to be an extremely effective measure for accelerating the TWC light-off.

SUMMARY

Proposed according to the invention are a method for operating a burner, in particular in an exhaust system downstream of an internal combustion engine, as well as a computing unit and a computer program for performing the method.

The invention creates a means of estimating a lambda value in an exhaust gas of a burner—even without a lambda probe—by determining a pressure pulsation value, in particular an amplitude of pressure pulsations or pressure oscillations, since it has been shown that this is related to the lambda value.

In detail, a method for operating a burner according to the invention comprises supplying a controlled quantity of combustion air to the burner, supplying a controlled quantity of fuel to the burner, igniting the air-fuel mixture in the burner, determining a pressure pulsation value in the exhaust gas downstream of the burner and/or in an air path upstream of the burner, and adjusting the quantity of combustion air and/or the quantity of fuel depending on the pressure pulsation value. This has the advantage that a pressure sensor and/or differential pressure sensor can be used to determine the fuel-air ratio or to adjust it, which is ready for use without a warm-up phase. Moreover, such pressure sensors are usually present in burner systems anyway to monitor the proper ignition of the burner. The invention can therefore bridge the time from burner start to readiness for use of a lambda probe arranged downstream of the burner, or the lambda probe can be omitted entirely.

In particular, the pressure pulsation value can comprise an amplitude of a pressure pulsation. This correlates strongly with the lambda value of the burner exhaust gas and is therefore particularly well suited for mixture control.

In some embodiments, the method further comprises determining a deviation of the pressure pulsation value from a predefinable reference value and adjusting the quantity of combustion air and/or fuel depending on the deviation. A threshold value can thereby be specified in order to, e.g., prevent the control from bouncing and imposing excessive fluctuations due to changing control interventions.

In particular, adjusting the quantity of combustion air and/or the fuel can in this case comprise increasing the quantity of fuel and/or decreasing the quantity of combustion air if the deviation falls below a predefinable first threshold value (at lambda>1, pressure pulsation value is low). Alternatively or additionally, adjusting the quantity of combustion air and/or the fuel can also comprise lowering the quantity of fuel and/or increasing the quantity of combustion air if the deviation exceeds a predefinable second threshold value (at lambda<1, the pressure pulsation value is high).

In particular, the adjustment can be proportional to the degree of the deviation determined. As a result, the deviation can be corrected very quickly. Alternatively, the adjustment can be made in defined, periodically repeating steps until the deviation is corrected. As a result, any non-linear dependency between the lambda value and the amplitude can be taken into account. For example, such non-linearities can be caused by fuel adsorbed or condensed on the burner wall. The gradual adjustment enables the time delay of the build-up and breakdown of the wall film.

In particular, the burner can be arranged in an exhaust system downstream of an internal combustion engine and upstream of at least one purification component of the exhaust system, in particular a catalytic converter. This is a particularly relevant application, as emissions from internal combustion engines, especially in motor vehicles, are subject to particularly strict limit values and, in particular, the start-up phase, in which the lambda probes used for exhaust gas monitoring are not yet at operating temperature, can contribute a significant proportion to the overall emissions of a vehicle.

A computing unit according to the invention, e.g., a control device of a vehicle, is configured, in particular in terms of program technology, to perform a method according to the invention.

The implementation of a method according to the invention in the form of a computer program or computer program product comprising program code for performing all of the method steps is also advantageous since this results in particularly low costs, in particular if a performing control device is also used for further tasks and is therefore provided in any event. Finally, a machine-readable storage medium is provided, on which the computer program as described hereinabove is stored. Suitable storage media or data carriers for providing the computer program are in particular magnetic, optical, and electrical memories, e.g., hard disks, flash memories, EEPROMs, DVDs, etc. Downloading a program via computer networks (internet, intranet, etc.) is also possible. Such a download can take place in a wired, cabled, or wireless manner (e.g., via a WLAN network, a 3G, 4G, 5G, or 6G connection, etc.).

Further advantages and embodiments of the invention will become apparent from the description and the accompanying drawings.

The invention is illustrated schematically in the drawing on the basis of an exemplary embodiment and is described below with reference to the drawings.

DETAILED DESCRIPTION

Figure 1:
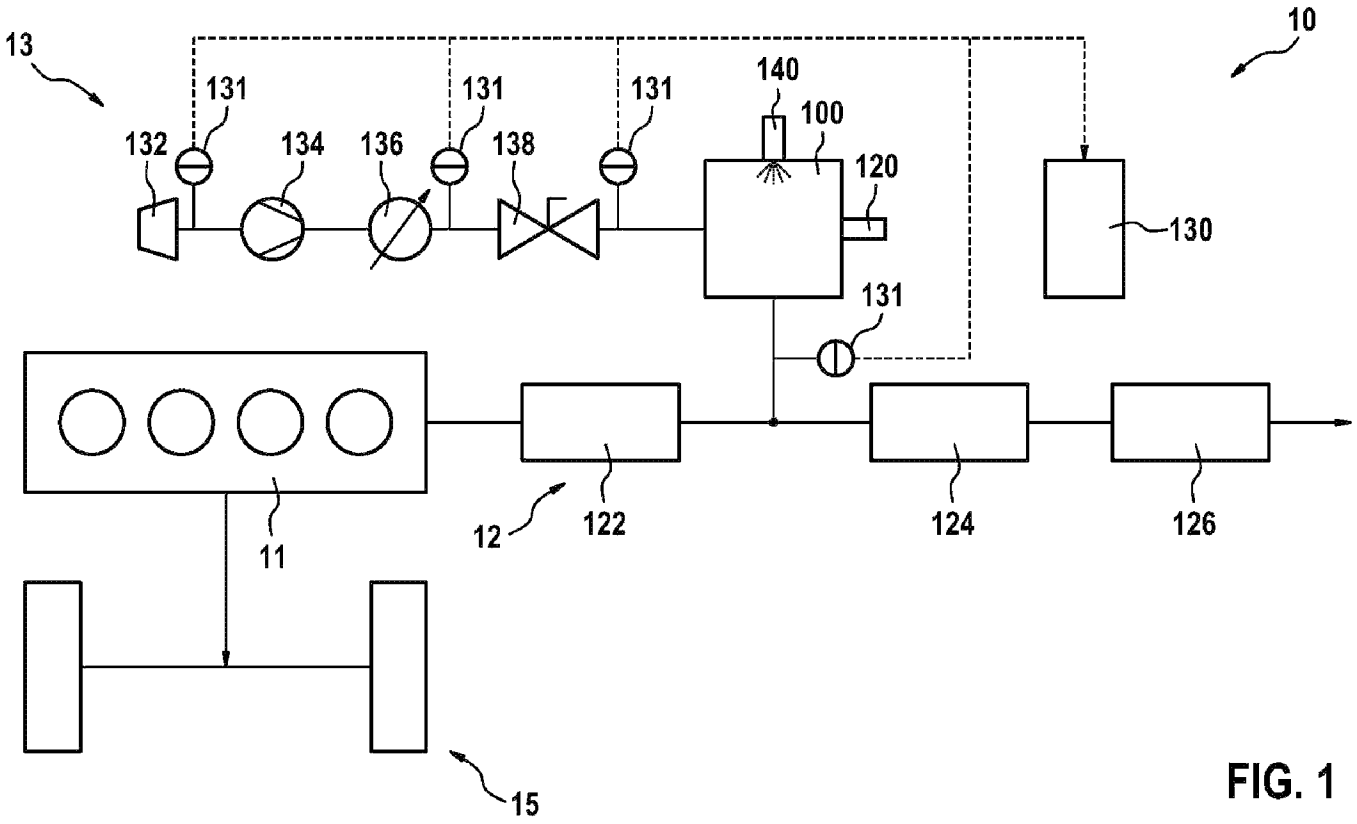
FIG. 1 shows a vehicle as it may be used in exemplary embodiments of the present invention in schematic representation.

In FIG. 1, a vehicle as may be used in the context of an exemplary embodiment of the invention is shown schematically and designated 10 overall. In the example shown, the vehicle 10 comprises an internal combustion engine 11, e.g., a spark-ignition reciprocating or rotary engine, an exhaust system 12, which is configured for the aftertreatment of an exhaust gas generated by the internal combustion engine 11 and for this purpose comprises, e.g., catalytic converters 122, 124 and soot particulate filters 126, an exhaust gas burner 100 for heating at least part of the exhaust gas system 12, and a secondary air system 13 which is configured to supply air to the exhaust gas system 12 and/or the exhaust gas burner 100 in order to enable or promote oxidation reactions.

The exhaust gas burner 100 comprises an ignition system 120, in this case in the form of a spark plug which can be energized, e.g., by means of an ignition coil, and a fuel supply 140, in this case in the form of an injection system. Fuel introduced into the exhaust gas burner 100 is reacted with introduced air during operation of the exhaust gas burner 100 using the ignition system 120, producing hot exhaust gases which are used to heat components of the exhaust system 12 arranged downstream of the exhaust gas burner, e.g., catalytic converters 124, particulate filters 126, lambda probes (not shown in FIG. 1), or the like. The essential feature of this design is the direct injection of the fuel and the associated interaction with the ignition system 120, although the invention is not limited to this design principle.

The secondary air system 13 in this cases comprises an air filter 132, an air pump 134, a sensor 136, e.g., an air mass and/or temperature sensor, and a secondary air valve 138, which can, e.g., be provided in the form of a shut-off valve, and which can prevent or permit the supply of air 130 from the secondary air system 13 into the exhaust gas burner 100 or the exhaust system 12. The secondary air system further comprises at least one pressure sensor 131. FIG. 1 shows four possible positions for the arrangement of the pressure sensor 131, whereby it should be explicitly emphasized herein that not all of these positions actually have to be occupied in every embodiment of the invention. In particular, the invention also works with only one pressure sensor 131 in any of the positions shown. The pressure sensor can alternatively be integrated in the sensor 136. The pressure sensor is connected to a computing unit 130, which is configured to process signals from the sensor 131 and to output control signals to the secondary air system 13 and/or the burner 100.

It is understood that the components of the vehicle 10 described herein need not necessarily be arranged in the order shown herein relative to one another. For example, the sensor 136 can also be arranged downstream of the valve 138 or the particulate filter 126 can be located upstream of the catalytic converter 124. It can also be advantageous to provide further components or to provide connections between the secondary air system 13 and the exhaust gas system 12 at other locations.

Figure 2:
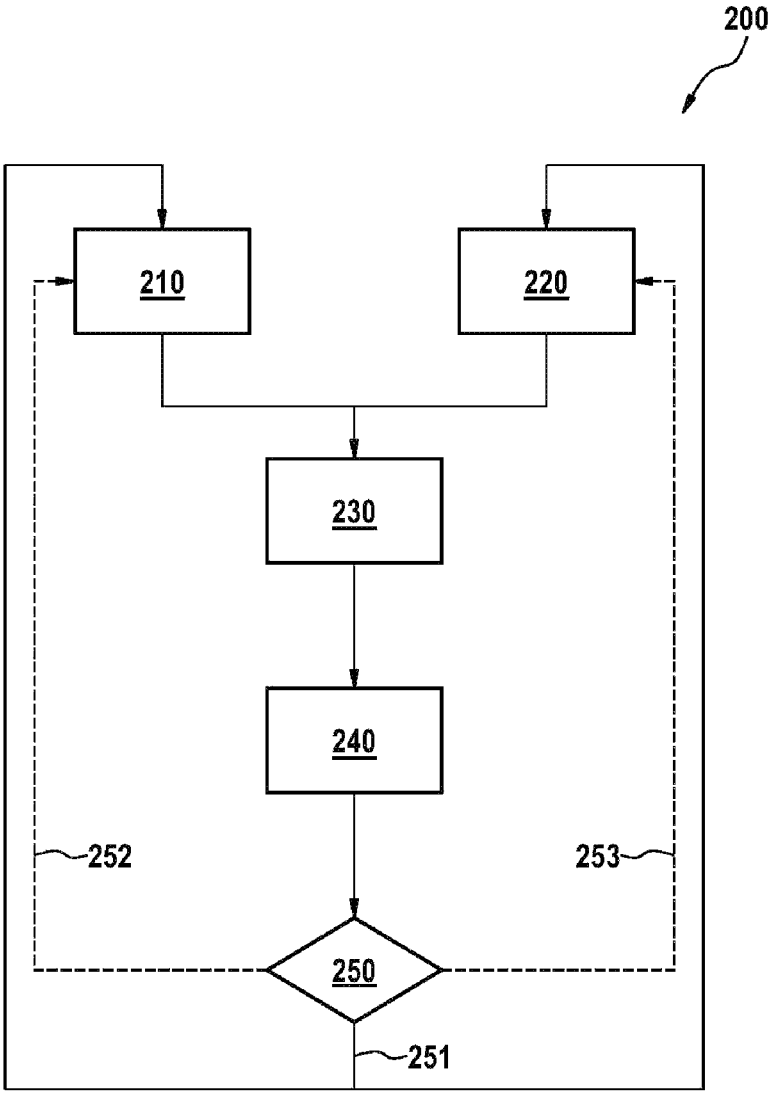
FIG. 2 shows an exemplary embodiment in the form of a highly simplified block diagram.

FIG. 2 shows an example of an exemplary embodiment of the invention using the example of a method schematically in the form of a highly simplified block diagram and designated 200. For the sake of clarity, the description of the method 200 is also provided in this case with reference to FIG. 1, whereby the arrangement of the various components from FIG. 1 is not necessarily required in order to perform the method 200.

The method 200 comprises metering a controlled or predefinable quantity of air 210 to the burner 100. For this purpose, the air pump 134 and the secondary air valve 138 are controlled so that the desired or required quantity of air can pass through the secondary air system 13.

Furthermore, the method comprises metering a controlled or predefinable quantity of fuel 220, for which purpose the injection system 140 is used in the exemplary embodiment presented herein. For example, the quantity of fuel can be selected in such a way that a heating requirement of a component of the exhaust system 12 is covered completely or to a predefinable proportion by the combustion of this quantity of fuel in the burner 100, in particular within a predefinable time period.

In step 230, the air-fuel mixture thus produced is ignited, with the ignition system 120 being used in this case. The combustion of the air-fuel mixture causes a volume expansion which, due to the intermittent injection, leads to a pressure pulsation inside and downstream of the burner 100 as well as in the secondary air system 13 upstream of the burner 100.

Figure 3:
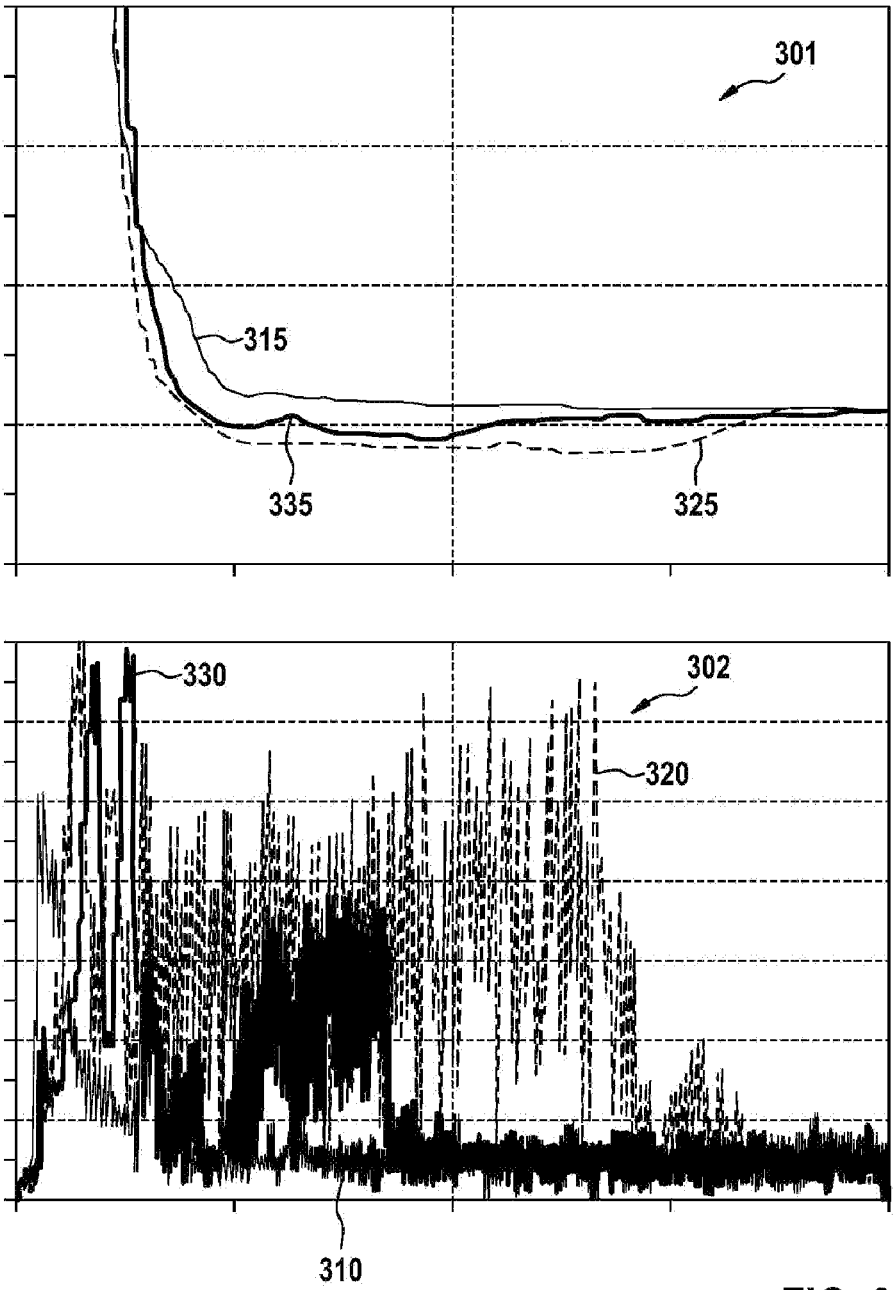
FIG. 3 shows exemplary signal progressions of sensor outputs, as they can be obtained and used within the scope of exemplary embodiments of the invention.

FIG. 3 shows exemplary signal progressions of sensor outputs, as they can be obtained and used in the context of exemplary embodiments of the invention, in the form of $\lambda/t$ or p/t diagrams. The $\lambda/t$ diagrams are in this case indicated as 301, and the p/t diagrams as 302. Signal progressions 310, 315 were obtained at a lean, i.e., over-stoichiometric, air-fuel mixture (more air than required for stoichiometric combustion of the metered quantity of fuel; $\lambda>1$). Signal progressions 320, 325 were obtained at a rich, i.e., sub-stoichiometric, air-fuel mixture (too little air for complete combustion of the metered fuel; $\lambda<1$). Finally, signal progressions 330, 335 were obtained when a stoichiometric mixture was set ($\lambda=1$). Lambda sensors at operating temperature were in this case used to generate the diagrams 301.

In the diagrams it can be seen that lambda values smaller than 1 and lambda=1 lead to large fluctuations or oscillations in the pressure signal (referred to as pressure pulsations), whereas in the case of lambda >1 only small oscillations occur.

In order to increase the lack of fuel evaporation during cold burner start, a brief mixture enrichment is performed when starting, whereby an ignitable mixture is achieved in the ignition system 120. The remaining liquid fuel accumulates on the wall and evaporates after flame formation due to the heating of the burner. Varying rich zones in "Lambda=1"

operation, which delay combustion or reduce the flame, result thereby. The goal is therefore a lean operation.

If necessary, combustion at a rich mixture produces a lower frequency of combustion pulsation than combustion at a lean mixture if the combustion chamber geometry is appropriate, so an evaluation of the pulsation frequency may be advantageous.

The high lambda values at the beginning of signal progressions 310, 320, 330 are due to the fact that unburnt mixture was measured downstream of the burner at burner start despite rich mixture due to a delay in combustion, e.g., due to incomplete ignition. Given the incomplete combustion, the exhaust gas still contains high proportions of oxygen, which leads to the high lambda values measured, although the composition of the mixture is actually sub-stoichiometric with regard to oxygen. At the lambda sensor used, the oxidation of the unburnt fuel cannot proceed fast enough to compensate for this effect.

The pressure pulsation generated by the combustion of the air-fuel mixture is detected in a step 240. The pressure sensor 131 is used for this purpose in the exemplary embodiment explained in this context. It is irrelevant whether the sensor 131 is positioned upstream or downstream of the burner 100, since the pressure pulsation, as indicated hereinabove, affects the entire secondary air system 13 upstream and downstream of the burner 100. A pulsation amplitude is determined from the sensor signal. For this purpose, local maxima and minima of the sensor signal can be evaluated and, e.g., one or more injection periods can be used as evaluation periods.

In a step 250, the amplitude thus determined (also referred to as pressure pulsation value in the context of the present invention) is compared with one or more reference values. For example, an average amplitude of the pressure signal when using a stoichiometric air-fuel mixture can be used as a reference value. If the determined amplitude deviates from the reference value by less than a predefinable threshold value, then the method returns to steps 210 or 220 without changing the respective metering (indicated by path 251 in FIG. 2).

If, on the other hand, the degree of the deviation between the determined amplitude and the reference value exceeds the threshold value, then the method 200 continues with modified metering in steps 210 and/or 220. For this purpose, the air metering (path 252) can be influenced as well as the fuel metering (path 253). Regardless of whether the air metering, the fuel metering, or both are adjusted according to the deviation determined in step 250, the result is an air-fuel mixture with a changed composition. The sign of the deviation in this case determines the direction of the adjustment of the composition: Given a determined amplitude that is higher than the reference value (i.e., positive deviation), it can be concluded that the air-fuel mixture is too rich (too low a lambda value), so a leaning of the mixture is performed (paths 252; increasing the quantity of air and/or 253; reducing the quantity of fuel). If, on the other hand, an amplitude is determined that is lower than the reference value (negative deviation), then enrichment is performed (reduction of the quantity of air; 252, or increase of the quantity of fuel; 253). Different threshold values for deviations with different signs can be used in this case. For example, an adjustment in the direction of enrichment can already be made if the reference value is undercut by 40%, whereas an adjustment in the direction of leaning can only be made if, e.g., the reference value is exceeded by 60%. These exemplary threshold values are in no way restrictive in this context, but are to be understood merely by way of example. In particular, the relation of the different threshold values to each other can also be different, e.g., reversed. In particular, one or more chronologically varying threshold values can be used in this case.

As explained hereinabove, the adjustment of the mixture composition can, e.g., be proportional to the determined deviation from the reference value, or the mixture can be adjusted step by step (e.g., evaluation every 100 ms) with a fixed change step (e.g., enrichment or leaning by 3% fuel content) until the deviation is corrected. The stepwise adjustment has the advantage that it functions independently of an actual physical relation, whereas a proportional change usually leads more quickly to the desired goal of an essentially stoichiometric mixture setting, but can lead to an oscillating system behavior in the case of any non-linearities that can occur. The level of adjustment of the mixture composition can also be determined using a characteristic map which returns a correction value for the quantity of air and/or fuel depending on the determined amplitude or the determined deviation between the amplitude and the reference value.

In cases where a lambda sensor is installed downstream of the burner 100, the method 200 can end when the lambda sensor has reached its operating temperature. Combustion control can then be continued in the conventional manner using the data collected by the lambda sensor. Reaching the operating temperature can, e.g., be assumed after a predefinable period of time or determined by comparing the stoichiometry determined by means of the method described herein and the stoichiometry determined using the lambda sensor.

It is understood that signals, in particular the detected pressure signals, can be suitably filtered, averaged, and otherwise processed within the scope of the method 200 presented herein without this being explicitly disclosed in each case.

The method 200 described herein is not only applicable with burners 100 in an exhaust system 12 downstream of an internal combustion engine 11, but in principle also applicable for other burner systems comprising a controllable fuel supply 140 and/or an air supply 13.

The invention claimed is:

1. A method (200) for operating a burner (100), comprising:

supplying (210) a controlled quantity of combustion air to the burner (100), supplying (220) a controlled quantity of fuel to the burner (100), igniting (230) an air-fuel mixture located in the burner (100), determining (240) a pressure pulsation value in an exhaust gas downstream of the burner (100), in an air path (13) upstream of the burner (100), or both, determining (250) a deviation of the pressure pulsation value from a predefinable reference value, and adjusting (252, 253) the quantity of combustion air, the quantity of fuel, or both depending on the deviation by increasing (253) the quantity of fuel and/or decreasing (252) the quantity of combustion air when the deviation falls below a predefinable first threshold value.

2. The method (200) according to claim 1, wherein the pressure pulsation value includes an amplitude of a pressure pulsation.

3. The method (200) according to claim 1, wherein adjusting (252, 253) the quantity of combustion air and/or the quantity of fuel includes decreasing (253) the quantity of fuel and/or increasing (252) the quantity of combustion air when the deviation exceeds a predefinable second threshold value.

4. The method (200) according to claim 1, wherein the adjustment (252, 253) is proportional to a degree of deviation determined.

5. The method (200) according to claim 1, wherein the adjustment (252, 253) is performed in defined and periodically repeating steps until the deviation is corrected.

6. The method (200) according to claim 1, wherein the burner (100) is arranged in an exhaust system (12) downstream of an internal combustion engine (11) and upstream of at least one purification component (124, 126) of the exhaust system (12.

7. A computing unit (130) which is configured to perform the method (200) according to claim 1.

8. A non-transitory computer-readable storage medium storing instructions that, when executed by tan electronic processor, perform a set of functions, the set of functions comprising:

supplying (210) a controlled quantity of combustion air to a burner (100), supplying (220) a controlled quantity of fuel to the burner (100), igniting (230) an air-fuel mixture located in the burner (100), determining (240) a pressure pulsation value in an exhaust gas downstream of the burner (100), in an air path (13) upstream of the burner (100), or both, determining (250) a deviation of the pressure pulsation value from a predefinable reference value, and adjusting (252, 253) the quantity of combustion air, the quantity of fuel, or both depending on the deviation by decreasing (253) the quantity of fuel and/or increasing (252) the quantity of combustion air when the deviation exceeds a predefinable second threshold value.

* * * * *